US009543050B2

(12) United States Patent
Blanchard

(10) Patent No.: US 9,543,050 B2
(45) Date of Patent: Jan. 10, 2017

(54) IMAGING APPARATUS AND METHOD FOR MONITORING RADIATION WITHIN A CLOSED STRUCTURE

(75) Inventor: Franck Blanchard, Manosque (FR)

(73) Assignee: Commissariat a L'Energie Atomique et aux Energies Alternatives, Paris (FR)

( * ) Notice: Subject to any disclaimer, the term of this patent is extended or adjusted under 35 U.S.C. 154(b) by 642 days.

(21) Appl. No.: 13/384,394

(22) PCT Filed: Jul. 16, 2010

(86) PCT No.: PCT/FR2010/000510
§ 371 (c)(1),
(2), (4) Date: Jan. 17, 2012

(87) PCT Pub. No.: WO2011/007061
PCT Pub. Date: Jan. 20, 2011

(65) Prior Publication Data

US 2012/0113245 A1 May 10, 2012

(30) Foreign Application Priority Data

Jul. 17, 2009 (FR) ..... 09 03526

(51) Int. Cl.
*G21F 7/02* (2006.01)

(52) U.S. Cl.
CPC ..... *G21F 7/02* (2013.01); *Y10T 29/4973* (2015.01)

(58) Field of Classification Search
CPC ..... H04N 7/18; B23P 6/00; G01T 1/00; G21F 7/02
(Continued)

(56) References Cited

U.S. PATENT DOCUMENTS 3,229,577 A * 1/1966 Ellinger ..... G02B 23/08 348/83
3,447,434 A 6/1969 Bougon
(Continued)

FOREIGN PATENT DOCUMENTS

CN 101040349 A 9/2007
EP 0 030 565 A1 6/1981
(Continued)

OTHER PUBLICATIONS

Notification of Reasons for Rejection dated Feb. 4, 2014 for corresponding Japanese Application No. 2012520062.
(Continued)

*Primary Examiner* — Jay Au Patel
*Assistant Examiner* — Irfan Habib
(74) *Attorney, Agent, or Firm* — Ladas & Parry LLP

(57) ABSTRACT

An observation instrument for use in a cavity in a hot cell includes a radiation sensor located between a dome and a shield and a travel mechanism for moving the sensor between a retracted position away from the dome and an observation position in which the sensor extends inside the dome and a method of maintaining the cell including extracting the shield, sensor, and travel mechanism from the cavity;

where appropriate, replacing the sensor;

inserting a replacement dome into the cavity and sliding it into the proximity of the dome that has remained in position in the cavity;

inserting the shield, sensor and travel mechanism into the cavity and sliding them into contact with the replacement dome; and moving the dome that has remained in position until it is expelled into the cell, by pressing the replacement dome against it.

16 Claims, 9 Drawing Sheets

(58) Field of Classification Search
USPC ..... 348/83
See application file for complete search history.

(56) References Cited

U.S. PATENT DOCUMENTS

| | | | | | |
|---|---|---|---|---|---|
| 4,427,894 | A * | 1/1984 | Sunaoshi | G21F 7/04 | 250/515.1 |
| 5,739,845 | A * | 4/1998 | Hansford | G02B 23/2492 | 348/83 |
| 6,111,599 | A * | 8/2000 | Nance | F27D 21/02 | 348/82 |
| 6,178,867 | B1 * | 1/2001 | Kovac | F15B 11/22 | 91/171 |
| 6,335,756 | B1 * | 1/2002 | Hale | A61B 1/00073 | 348/82 |
| 6,556,344 | B2 * | 4/2003 | Koren | H01S 5/026 | 359/341.4 |
| 6,806,900 | B2 * | 10/2004 | Eversole | H04N 5/2252 | 348/143 |
| 2004/0006448 | A1 * | 1/2004 | Penza | G02B 23/2484 | 702/183 |
| 2004/0028168 | A1 | 2/2004 | Suvorov et al. | | |
| 2006/0180767 | A1 * | 8/2006 | Ramsden | G01T 1/1642 | 250/369 |
| 2008/0095295 | A1 * | 4/2008 | Fuls | G21F 5/10 | 376/272 |
| 2008/0242980 | A1 * | 10/2008 | Lees | A61B 6/4258 | 600/436 |
| 2009/0207191 | A1 * | 8/2009 | Zarubinsky | H04N 5/202 | 345/690 |

FOREIGN PATENT DOCUMENTS

| | | | |
|---|---|---|---|
| FR | 1 347 746 | A | 1/1964 |
| FR | 1259728 | A | 2/1964 |
| FR | 1 484 712 | A | 6/1967 |
| FR | 2 045 100 | A5 | 2/1971 |
| GB | 949826 | A | 3/1961 |
| GB | 1 112 055 | A | 5/1968 |
| GB | 2 096 717 | A | 10/1982 |
| GB | 2 242 214 | A | 9/1991 |
| JP | S60-153063 | U | 10/1985 |
| JP | S60-153067 | U | 10/1985 |
| JP | 2 264898 | A | 10/1990 |
| JP | H04-85199 | U | 7/1992 |
| JP | H05-59396 | U | 8/1993 |
| JP | 6 066995 | A | 3/1994 |
| JP | 06066995 | A * | 3/1994 |
| JP | H06-66995 | A | 3/1994 |
| JP | 8 043313 | A | 2/1996 |
| JP | H08-43313 | A | 2/1996 |
| WO | 95/24720 | A1 | 9/1995 |

OTHER PUBLICATIONS

Notification of the First Office Action and Search Report dated Mar. 27, 2014 for corresponding Chinese Application No. 201080032033.4.

* cited by examiner

IMAGING APPARATUS AND METHOD FOR MONITORING RADIATION WITHIN A CLOSED STRUCTURE

RELATED APPLICATION INFORMATION

This application is a 371 of International Application PCT/FR2010/000510 filed 16 Jul. 2010 and entitled "DEVICE FOR OBSERVING THE INSIDE OF A HOT CELL, HOT CELL PROVIDED WITH SAID DEVICE, AND METHOD FOR MAINTAINING SAID DEVICE", which was published on 20 Jan. 2011, with International Publication Number WO 2011/007061 Al, and which claims priority from France Patent Application 0903526, filed 17 July 2009.

TECHNICAL FIELD

The present invention relates to an instrument for a hot cell, to a hot cell fitted with an instrument, and to a method of maintaining the instrument.

The technical field of the invention is that of fabricating instruments for monitoring or observing the inside of a structure—or a compartment—that receives radioactive materials or substances.

In the present application, the terms "cell" and "hot cell" are both used to designate such a structure.

The present invention applies in particular to monitoring hot cells by acquiring images of zones situated in a hot cell, and by measuring the rays emitted in said zones, over wavelength-ranges that are visible or invisible for a human being.

STATE OF THE ART

A hot cell within which it is possible to store, manipulate, or otherwise process radioactive materials or substances generally comprises thick walls that form a biological protection shield to protect a person situated outside the cell from the radiation emitted by the materials or substances that it contains.

These thick walls may be constructed, at least in part, by barytes concrete or lead.

In order to observe a zone of interest inside the cell, it is possible to have an observation sensor, such as a video camera, inside the cell, and to protect the sensor from the radiation by placing it in a lead box while it is not in use. Means for remotely manipulating items, such as a remote manipulator, may be used for moving the camera, for focusing a camera lens, and/or for adjusting the magnification of a zoom function of the lens.

Nevertheless, such manipulations and adjustments may be difficult to perform and they occupy a remote manipulator arm, thereby limiting capacity for taking action in the cell.

The lifetime of the camera—or other sensor—is also shortened because of the radiation it receives, even when it is protected at rest by a lead box.

Another drawback may result in the presence of a cable inside the cell connecting the sensor to an appliance located outside the cell. The cable may hinder operations that are to be performed inside the cell and it may be damaged, thereby interrupting operation of the sensor.

Items or phenomena inside the cell may be observed visually directly via a thick window incorporated in the wall of the cell. Nevertheless, such a window is expensive and it does not enable high quality images to be obtained of all of the zones inside the cell.

It is known to observe items or phenomena inside such a structure by means of a sensor arranged outside the structure, acting via a light guide with mirrors, of the periscope type, and as described in particular in patents FR 1 259 728 and GB 949 826.

Proposals have also been made, e.g. by the (French) supplier Sodern under the name "Periscope PC1200", for an observation instrument that extends, in part, inside a cavity passing through the thick wall forming a biological protection shield. The instrument includes a dome made of non-browning glass or of fused silica, which dome is mounted to project inside the cell, and receives a pivoting mirror. A zoom lens and a protective shield are housed in the cavity, with the pivoting mirror and the zoom lens enabling zones of the cell to be observed by a binocular eyepiece and a camera arranged outside the cell.

Document WO 95/24720 also describes an observation instrument that comprises a camera arranged outside a cell. A periscope extends into a cavity by passing through the wall of the cell and enables the camera to observe regions that extend inside the cell. For this purpose, the periscope includes a prism that is movable in pivoting about two axes, together with a quartz dome protecting the prism.

Patent JP 02 264 898 also describes an instrument for observing the inside of a hot cell by using a periscope protected by a bellows. That document describes a shaft and a rod that are used prior to extracting the periscope for the purpose of disengaging a window frame forming part of the bellows from a window frame forming part of the periscope, so as to leave the bellows in place. Before being put back into place, the periscope is fitted with a new bellows, and the bellows that was left in place is expelled into the hot cell.

A drawback of those instruments is that the observable field is limited; a limited angle of vision means there are some zones within the cell that cannot be observed.

A drawback of instruments that include a dome is that the dome is expensive. Replacing such a dome runs risks of contamination and radiation, is complex to perform, and takes the hot cell out of action for a long time.

Another drawback of such instruments is that they enable visual observation only; in particular such instruments do not enable length dimensions to be measured between two points within the hot cell.

SUMMARY OF THE INVENTION

An object of the invention is to propose a monitoring instrument, a hot cell incorporating said instrument, and a method of maintaining said instrument, that present improvements and/or that remedy, at least in part, the shortcomings or drawbacks of known hot cell monitoring instruments, known hot cells, and known methods of maintaining hot cell monitoring instruments.

An object of the invention is to provide an observation instrument, a hot cell incorporating the instrument, and a method of maintaining the instrument, all of which facilitate replacing components of the instrument.

According to an aspect of the invention, a cell is proposed that includes a wall pierced by a cavity and a monitoring instrument for monitoring zones inside the cell, which instrument extends—generally in part—through and/or along the cavity; the instrument comprises a sensor, a dome projecting into the inside of the cell, and a biological protection shield; the instrument further comprises a travel mechanism for moving the sensor between a "retracted" (first) position for protecting the sensor, in which position the sensor is housed inside the cavity, and an "observation"

or "acquisition" (second) position, in particular for observing or acquiring images of zones of the cell, in which position the sensor is housed inside the dome; furthermore, the dome is mounted slidably in the cavity and it is separable from the instrument such that the dome can be replaced by being expelled into the cell, such that'the angle and the field of vision of the sensor are enlarged—in the observation position—and such that the protection of the sensor is improved.

According to another aspect of the invention, there is provided an observation instrument for observing zones inside a hot cell, which instrument is arranged to be capable of extending—generally in part only—inside a cavity passing through a wall of the cell; the instrument comprises a dome provided at a first end of the instrument and arranged to project into the inside of the cell, a biological protection shield, and an observation sensor that is sensitive to rays or radiation and that is disposed between the dome and the shield; the instrument further comprises a travel mechanism for moving the sensor between a "retracted" (first) position for protecting the sensor, in which position the sensor is housed inside the cavity, and an "observation" (second) position for observing zones of the cell, in which position the sensor is housed inside the dome; the sensor travel mechanism is arranged between the dome and the shield; in addition, the dome is arranged to be capable of sliding in the cavity in the wall of the cell and it is mechanically independent of—i.e. separate from, disjoint from—the sensor, its travel mechanism, and the shield of the instrument, such that the dome may be left in position inside the cavity when dismantling the instrument, prior to being expelled into the cell.

In other words, and according to another aspect of the invention, an instrument is proposed for a cell that includes a wall pierced by a cavity, the instrument comprising two distinct modules that are separate (not connected together):

- a first module of the instrument comprises a biological protection shield and a sensor sensitive to rays or radiation, the sensor being secured to the shield by a travel mechanism for moving the sensor between a retracted position for protecting the sensor and a deployed position for observing the cell; and
- a second module of the instrument comprises a dome that is substantially transparent to said rays or radiation;

each of the two modules including a mutual bearing face, the two modules being capable of being put into mutual contact via their respective mutual bearing faces when the modules are engaged (by sliding) in the cavity in the wall of the cell.

The first module is designed to be inserted into the cavity in the wall of the cell and to be extracted from the cavity, to the outside of the cell, generally by sliding.

The second module is designed to be inserted into the cavity in the wall of the cell and to be extracted from the cavity, into the inside of the cell, likewise generally by sliding.

According to another aspect of the invention, there is provided a method of maintaining a cell including a wall pierced by a cavity that is fitted with an observation instrument, the instrument comprising a dome projecting into the inside of the cell, a biological protection shield, a sensor arranged between the dome and the shield, and a travel mechanism for moving the sensor between a retracted position inside the cavity and a deployed position, the method comprising the following operations in succession:

- extracting the biological protection shield, the sensor, and the sensor travel mechanism from the cavity to the outside of the cell;
- where appropriate, replacing the sensor;
- inserting a replacement dome in the cavity in the proximity of—or in contact with—the dome that has remained in position in the cavity;
- inserting the biological protection shield, the sensor, and the sensor travel mechanism into the cavity in contact with the replacement dome; and
- moving the dome that has remained in position in the cavity until it is expelled into the inside of the cell by pressing the replacement dome against the dome that has remained in position.

In embodiments of the invention:

- the wall of the cell includes an abutment that is movable between a stop position in which the abutment prevents the dome from being expelled into the cell, and a release position in which the abutment allows the dome to be expelled into the cell;
- the dome is secured to a tubular sleeve fitted with two O-rings and it is arranged to slide in a tubular bushing lining the cavity (which bushing is likewise tubular in shape), the O-rings being arranged to be in contact with the bushing; this makes it possible while expelling the dome into the cell under thrust from a replacement dome to maintain sealing between the inside and the outside of the cell via at least one of the two O-rings;
- the dome includes a wall that is substantially hemispherical and substantially transparent to said rays or radiation, which dome is made of plastics material, in particular of polycarbonate;
- the sensor travel mechanism includes a (first) actuator, such as an electric motor, for causing the sensor to move in translation along the longitudinal axis of the instrument as a function of first sensor travel control signals;
- the sensor travel mechanism includes a (second) actuator, such as an electric motor, for causing the sensor to move in turning about the longitudinal axis of the instrument as a function of second sensor travel control signals;
- the sensor travel mechanism includes a (third) actuator, such as an electric motor, for causing the sensor to move in pivoting about an axis substantially orthogonal to the longitudinal axis of the instrument as a function of third sensor travel control signals;
- the sensor includes and/or is essentially constituted by an imaging sensor such as a camera having a detector of the charge-coupled device (CCD) or of the complementary metal oxide on silicon (CMOS) type, for example, a controlled or automatic focusing lens, and a motor-driven zoom function; the camera may present a sensitivity peak in wavelength ranges that correspond to visible light, i.e. in the range extending from about 400 nanometers (nm) to about 800 nm, or indeed outside said range, e.g. in the infrared range; and
- the sensor includes and/or is essentially constituted by a gamma ray detector.

The invention makes it possible to obtain an observation instrument for a hot cell that is of low manufacturing cost, of lifetime that is increased, and of utilization and maintenance that are facilitated.

The invention makes it possible in particular to obtain a simple device for viewing in color that is capable of operating under irradiation.

Other aspects, characteristics, and advantages of the invention appear from the following description, which refers to the accompanying figures and relates to preferred embodiments of the invention without any limiting character.

DETAILED DESCRIPTION OF THE INVENTION

Unless indicated explicitly or implicitly to the contrary, any elements or members that are structurally or functionally identical or similar are designated in the various figures by references that are identical.

Figure 1:
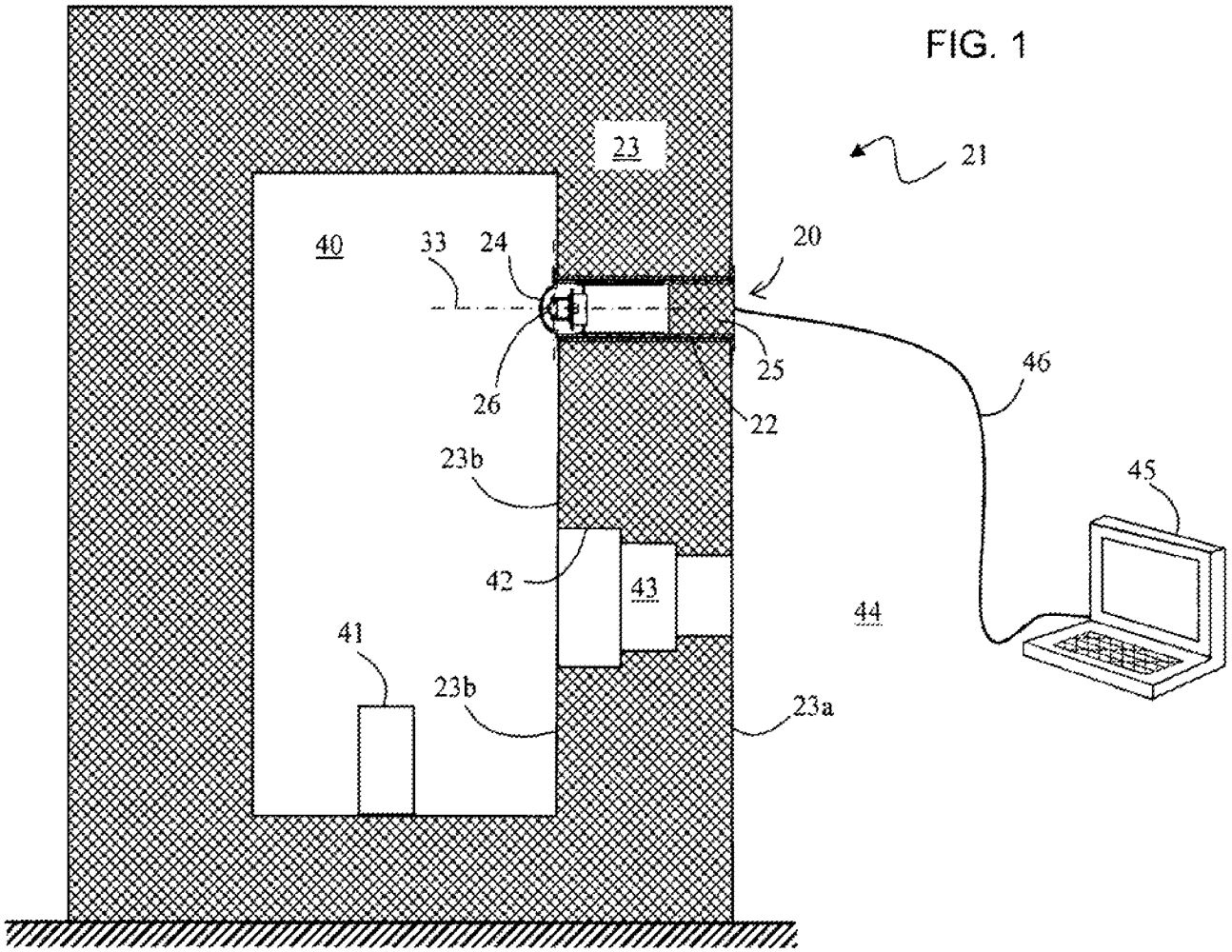
FIG. 1 is a diagrammatic section view showing a hot cell fitted with an observation instrument.

With reference to FIG. 1 in particular, the hot cell 21 has thick walls 23 defining a chamber 40 in which radioactive items 41 are placed.

The chamber 40 may be maintained at a pressure that is reduced relative to the surrounding atmosphere, i.e. relative to the outside 44 of the cell.

A wall 23 is pierced by a first opening or cavity 42 receiving a window 43 enabling an operator situated on the outside 44 of the cell to observe the items 41 directly through said window.

The wall 23 is pierced by a second opening/cavity 22 that receives an observation appliance or instrument 20 that extends along a substantially horizontal axis 23 inside the cavity 22.

The instrument 20 is connected via a link 46 to a computer 45 enabling an operator to cause a sensor 26 that forms part of the instrument to be deployed, or on the contrary to be retracted, to control the orientation of the sighting axis of the sensor as described below, and to recover data from the sensor.

Figure 2:
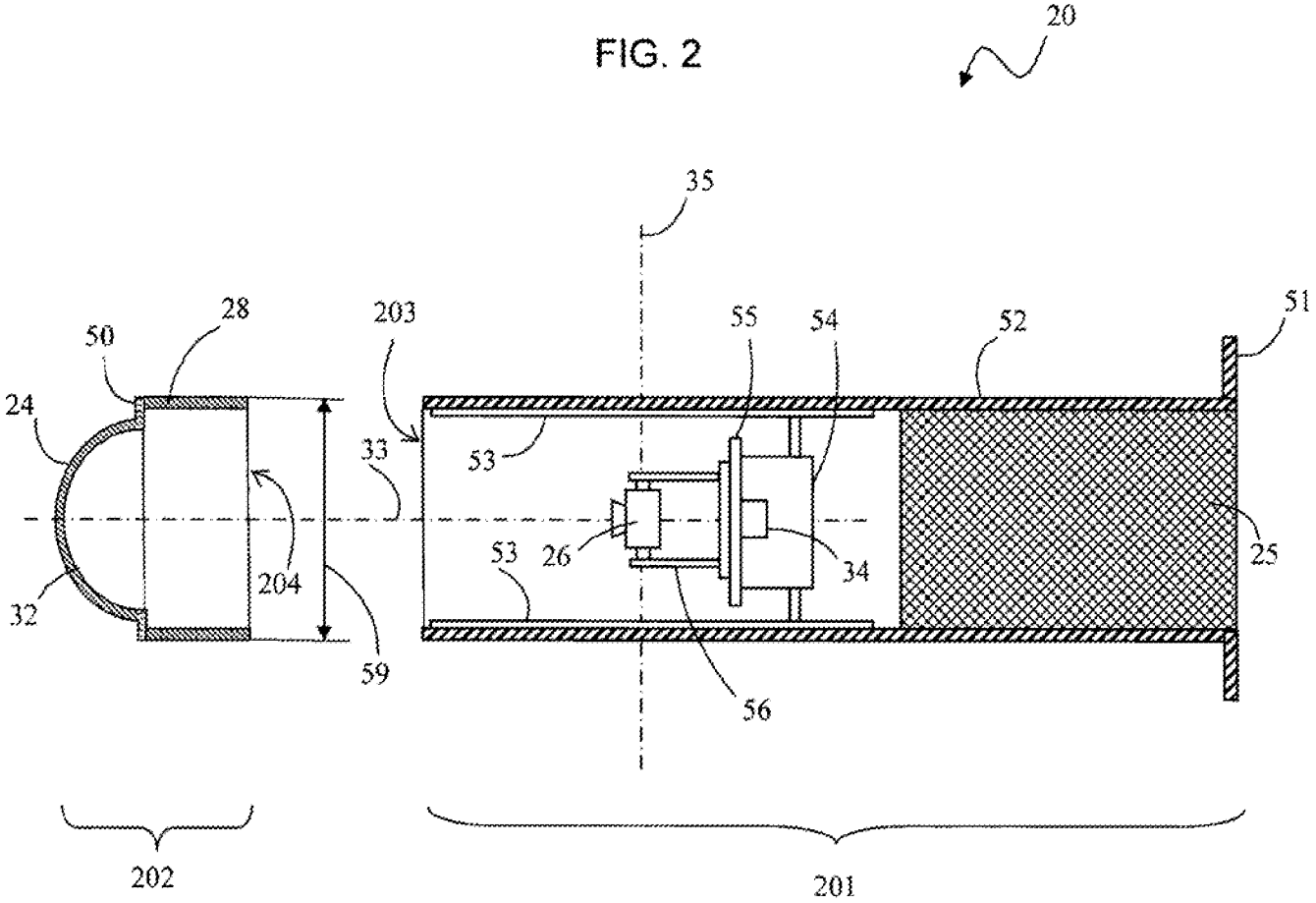
FIG. 2 is a diagram on a larger scale and in longitudinal section showing the two modules of an observation instrument in a retracted configuration of the sensor.

With reference to FIG. 2 in particular, the instrument 20 comprises two modules 201 and 202.

The first module, or slider or plug, 201 of the instrument comprises a biological protection shield 25 and a sensor 26 that is sensitive to rays or radiation, in particular a video camera.

The sensor 26 is secured to the shield by means of a travel mechanism that enables the sensor 26 to be moved between a retracted position inside the cavity 22 that receives the module 201, so as to protect the sensor from the radiation emitted by items situated inside the cell, and a deployed position, outside the cavity 22 and inside the cell, for observing zones of interest inside the cell.

Figure 3:
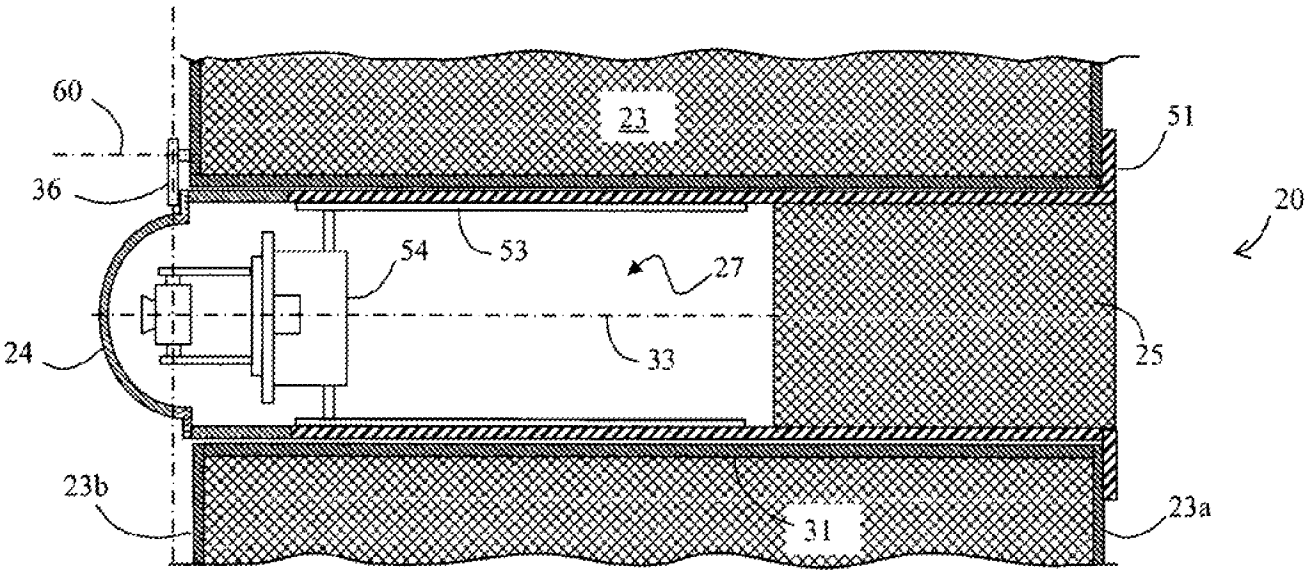
FIG. 3 is a diagram in longitudinal section view showing the FIG. 2 observation instrument installed in the cavity in a wall of a cell, in a deployed configuration of the sensor.
Figure 4:
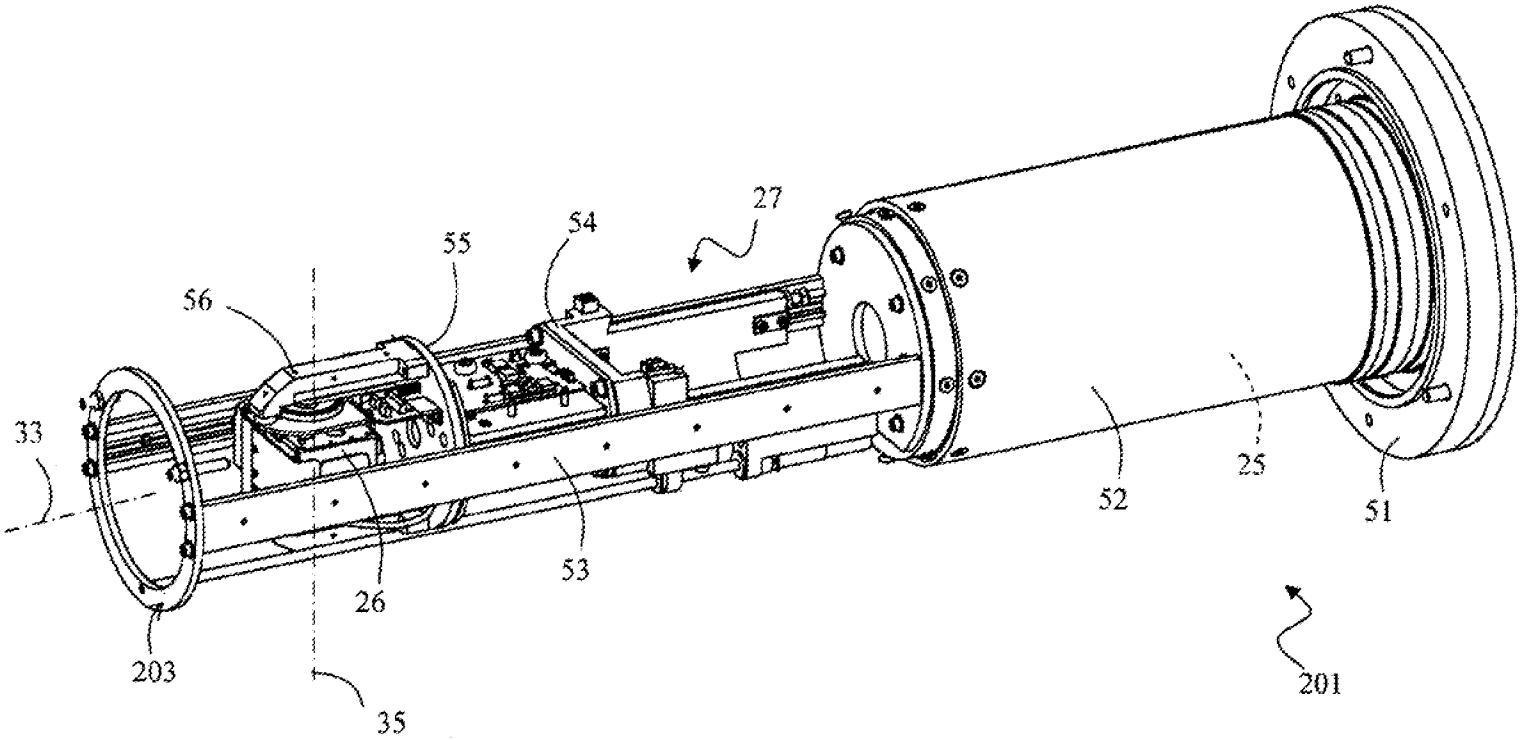
FIG. 4 is a diagram in perspective view of a (first) module of an observation instrument that is extractable to the outside of the cell.

The travel mechanism 27 can be seen in particular in FIGS. 2 to 5 and it is identified in FIGS. 3 and 4. It comprises two rails 53 secured to a tube 52 of axis 33, with the shield 25 being provided therein. The rails 53 extend parallel to the axis 33.

The mechanism 27 also includes a carriage 54 slidable on the rails 53 along the axis 33 under drive from an actuator such as an electric jack.

The carriage 54 carries circuits for powering the sensor 26 and for processing signals delivered by the sensor, together with a turntable 55 mounted to turn about the axis 33 and driven in turning by an actuator 34, such as an electric motor, which is mounted on the carriage 54.

The turntable 55 caries two arms 56 relative to which the sensor 26 is mounted to pivot about an axis 35 perpendicular to the axis 33, under drive from an actuator.

The mechanism including the turntable 55 and the arms 56 thus forms a turret with spherical coordinates that enables the camera 26 to be pointed over an amplitude of 360 degrees about each of the two axes 33 and 35, as a function of control signals for moving the sighting axis of the camera and as sent by the computer 45 to the mechanism 27, in response to data input into the computer by an operator.

The camera is thus mounted in a retractable turret, i.e. a turret that is retractable by moving in translation along the axis 33, thereby enabling the camera to be protected except during periods in which it is in use for observing zones in the cell.

This also serves to provide the electronic circuits associated with the camera and mounted on the carriage 54 with protection from irradiation.

Thus, the travel mechanism 27 for moving the sensor 26 has three axes or degrees of freedom: a first actuator for moving the turret and the sensor in translation along the longitudinal axis 33 of the instrument; a second actuator 34 for turning the sensor about the longitudinal axis 33; and a third actuator for pivoting the sensor about the axis 35.

Image processing software may be installed in the computer 45 in order to measure dimensions from images or image data delivered to the computer by the camera 26. A software module may enable calibration to be performed by analyzing images that are obtained when observing a ruler. After calibration, it is possible in particular to obtain a measurement of the length between two points by causing the camera to sight those two points.

Figure 5:
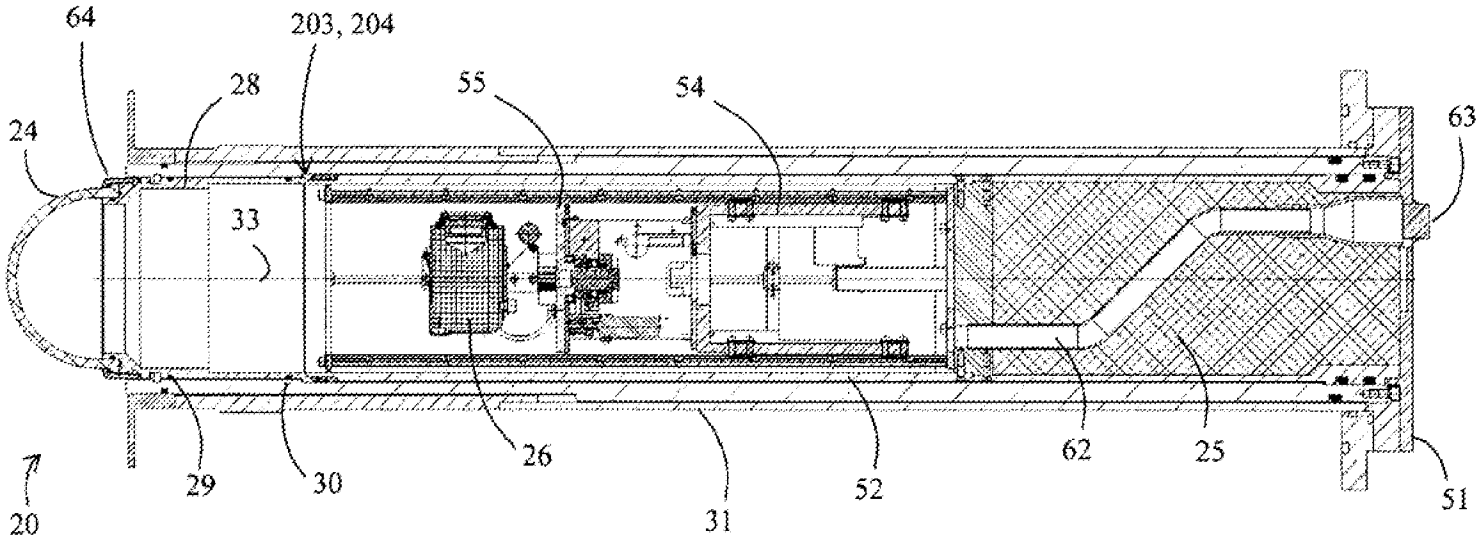
FIG. 5 is a diagram in longitudinal section view showing the instrument comprising the module of FIG. 4 together with a second module including an observation dome, in a configuration for retracting the sensor inside the cavity provided in the wall of the cell.
Figure 6:
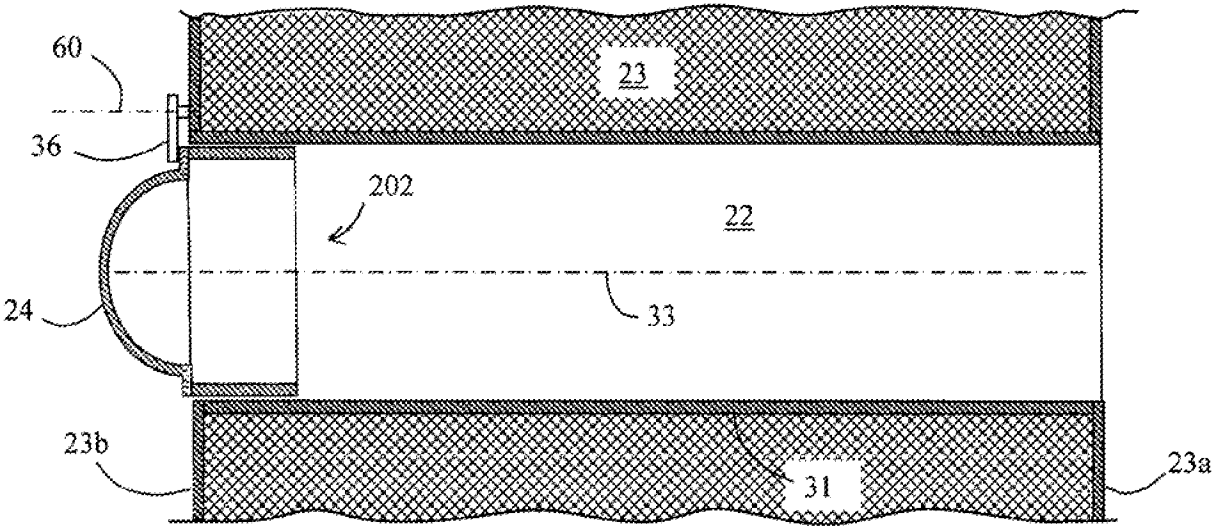
FIGS. 6 to 9 are diagrams showing the main steps and operations in a method of maintaining the instrument and the cell that is fitted therewith.

As shown in FIGS. 2 and 5 in particular, the second module 202 of the instrument 20 includes a dome 24 having a wall 32 of plastics material that is hemispherical and transparent to the rays or radiation, in particular to visible light and/or to gamma rays.

The dome 24 is dimensioned to receive the sensor 26 and to enable it to turn about the two axes 33 and 35, and it is arranged to project from the inside face 23*b* of the wall 23.

The module 202 also includes a tubular sleeve 28 about the longitudinal axis 33, which sleeve is secured to the dome 24 and is fitted with two O-rings 29 and 30.

The sleeve 28 is arranged to slide in a tubular bushing 31 lining the cavity, the O-rings coming into contact with the bushing (cf. FIG. 5).

Figure 7:
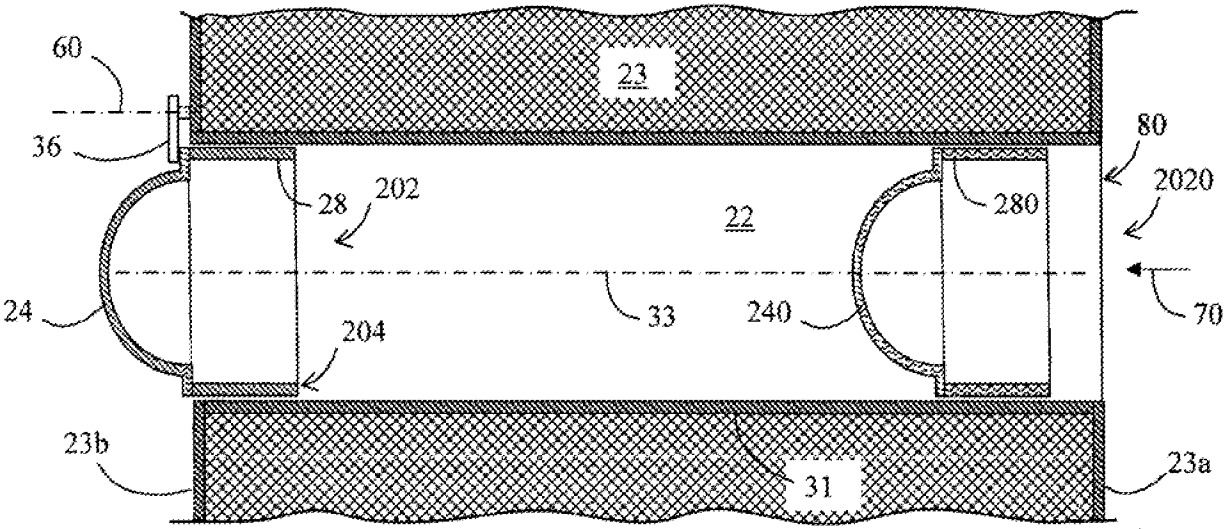
Figure 8:
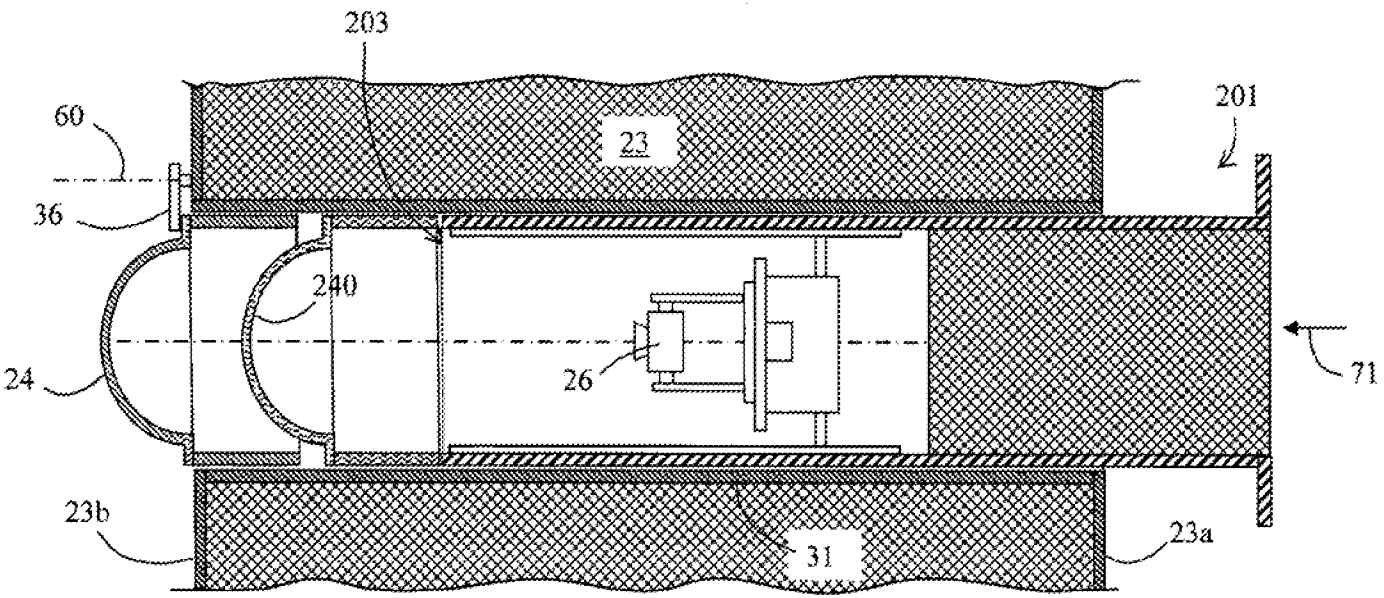
Figure 9:
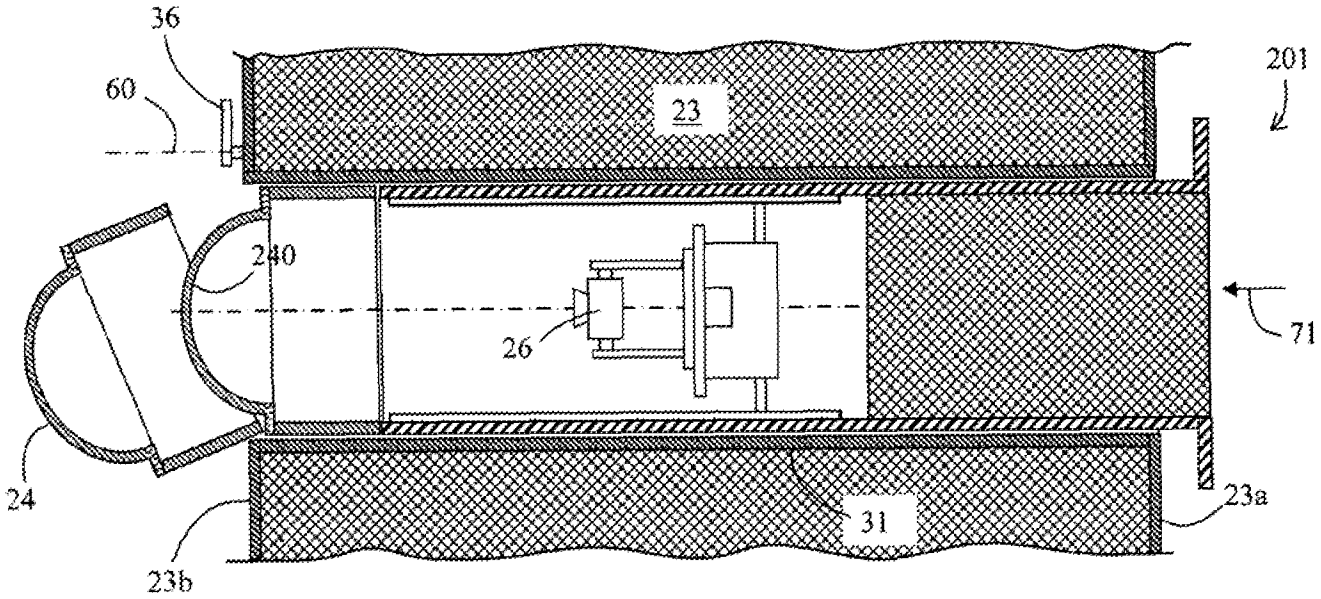

Each of the two modules has a respective annular face 203, 204 for bearing mutually one against the other, it being possible for the two modules to be put into mutual contact via their respective mutual bearing faces after they have been engaged successively in the cavity in the wall of the cell (cf. FIGS. 7 to 9).

More particularly, in FIG. 2 in particular, it can be seen that the bearing face 204 is situated at one end of the sleeve 28 and that the bearing face 203 is situated at the end of the tube 52 that acts as the housing of the module 201.

These two end bearing faces present a diameter 59 that is substantially common to both of the parts 28 and 52, thus enabling them to be placed facing each other.

This diameter 59 is substantially greater than the diameter of the dome 24. The dome 24 is connected to the tubular/cylindrical sleeve 28 via an annular link part 64 (cf. FIG. 5) having a bearing face 50 that projects from the periphery of the dome.

In FIG. 5, it can be seen that the shield 25 has a bent channel 62 passing therethrough and designed to receive electrical conductors for conveying signals and power.

These conductors connect the sensor 26 and the actuators of the mechanism 27 to a connector 63 that is provided at the "rear" face of the module 201.

This connector enables the instrument 20 to be connected to a monitoring and control unit such as a computer 45 (FIG. 1).

In FIGS. 3 and 6 to 9 it can be seen that the wall of the cell includes an abutment 36 that is mounted to turn about an axis 60 that is parallel to the axis 33 between a stop position (FIGS. 3 and 6 to 8) in which the abutment 36 prevents the dome 24 from being expelled into the cell, and a release position (FIG. 9) in which the abutment allows the dome to be expelled into the cell.

This abutment 36, which is arranged on the inside face 23*b* of the wall 23, may be moved from one of these positions to the other by a remote manipulator controlled by an operator, in order to replace the dome 24, and where appropriate the sensor 26.

For this purpose, and with reference to FIGS. 3 and 6 to 9 in particular, maintenance of the cell 21 and dismantling of the observation instrument 20 comprise the following successive operations:

- starting from the configuration shown in FIG. 3, retracting the sensor 26 to a position close to the shield 25;
- extracting the first module 201 of the instrument, including the biological protection shield 25, the observation sensor 26, and the travel mechanism 27 out from the cavity 22, to the outside 44 of the cell (cf. FIG. 6);
- where appropriate, replacing the observation sensor fitted to the module 201;
- from the outside end 80 of the cavity 22, inserting a dome 240 forming part of a replacement second module 2020, by sliding along the axis 33 in the direction of arrow 70 (FIG. 7), into the cavity 22 into the proximity of or in contact with the bearing face 204 of the dome 24 that has remained in position in the cavity;
- inserting the first module 201 into the cavity 22 and sliding it along the axis 33 in the direction of arrow 71 (FIG. 8) until the bearing face 203 of the module 201 makes contact with the replacement dome 240; and
- continuing to exert thrust on the module 201 (arrow 71 in FIG. 9) so as to bring the two modules 202, 2020—and/or the two domes 24, 240—into mutual contact and cause the dome 24 that has remained in place inside the cavity to be moved until it is expelled into the inside of the cell, by means of the replacement dome/module pressing against the dome/module that has remained in position.

To this end, the movable abutment 36 is momentarily retracted, as described above. After this abutment 36 has been put back into its stop position, the replacement dome is placed in its final position by continuing to exert thrust on the module 201, and then the module is held stationary by its flange 51 coming to bear against the outside face 23*a* of the wall 23.

The invention claimed is:

1. An observation instrument inside a thick-walled radiation shielded cell, wherein the instrument is arranged to be capable of extending inside a cavity passing through a wall of the cell, the instrument comprising two separate modules:

- a first module of the instrument comprising a biological protection shield, a camera for acquiring images of zones situated in the cell; and
- a travel mechanism for moving the camera between a retracted position to which the camera is retracted into the cavity and a deployed position for observing the inside of the cell, the travel mechanism being coupled to the camera and including an actuator for causing the camera to move between the retracted position and the deployed position; and
- a second module of the instrument comprising a dome that is substantially transparent to rays or radiation and that is arranged to be capable of receiving the camera therein when the camera is in the deployed position for observation;
- each of the two modules including a mutual bearing face, the two modules being capable of being put into mutual contact via their respective mutual bearing faces when the modules are engaged in the cavity,
- the camera being arranged between the dome and the shield, and being secured to the shield via the travel mechanism
- the dome being provided at a first end of the instrument
- the actuator causing the camera to move between the retracted position away from the dome and the deployed position in which the camera extends inside the dome,
- the travel mechanism being arranged between the dome and the shield, and
- the dome being separate from the camera, from travel mechanism, and from the shield of the instrument.

2. An instrument according to claim 1, wherein the dome is secured to a tubular sleeve fitted with two O-rings and is arranged to slide in a tubular bushing lining the cavity, the O-rings being arranged to be in contact with the bushing.

3. An instrument according to claim 1, wherein the dome comprises a substantially hemispherical wall.

4. An instrument according to claim 3, wherein the wall is made of a plastics material, in particular of polycarbonate.

5. An instrument according to claim 1, wherein the travel mechanism comprises:

- a first actuator for causing the sensor to move in translation along the longitudinal axis of the instrument;
- a second actuator for causing the sensor to move in turning about the longitudinal axis; and
- a third actuator for causing the sensor to move in pivoting about an axis that is substantially orthogonal to the longitudinal axis.

6. An instrument according to claim 1, wherein the camera includes a controlled or automatic focusing lens with a motor-driven zoom function.

7. An instrument according to claim 1, wherein the camera includes a motor-driven zoom function.

8. A cell including a wall pierced by a cavity and an instrument according to claim 1 that extends inside the cavity.

9. A cell according to claim 8, wherein the wall of the cell includes an abutment that is movable between a stop position in which the abutment prevents the dome from being expelled into the cell, and a release position in which the abutment allows the dome to be expelled into the cell.

10. An observation instrument for observing the inside of a thick-walled radiation shielded cell, wherein the instrument is arranged to be capable of extending inside a cavity passing through a wall of the cell, the instrument comprising two separate modules:

a first module of the instrument comprising:

a biological protection shield;

a gamma ray detector for measuring gamma rays emitted in zones situated in the cell; and a travel mechanism for moving the detector between a retracted position in which the detector is retracted into the cavity and a deployed position for observing the inside of the cell, the travel mechanism being coupled to the detector and including an actuator for causing the detector to move between the retracted position and the deployed position; and a second module of the instrument comprising a dome that is substantially transparent to rays or radiation and that is arranged to be capable of sliding in the cavity, which dome is capable of receiving the detector therein when the detector is in the deployed position for observation;

each of the two modules including a mutual bearing face, the two modules being capable of being put into mutual contact via their respective mutual bearing faces when the modules are engaged in the cavity, the detector being arranged between the dome and the shield and being secured to the shield via the travel mechanism, the dome being provided at a first end of the instrument, the actuator causing the detector to move between the retracted position away from the dome and the deployed position in which the detector extends inside the dome, the travel mechanism being arranged between the dome and the shield, and the dome being separate from the detector, from the travel mechanism, and from the shield of the instrument.

11. An instrument according to claim 10, wherein the dome is secured to a tubular sleeve fitted with two O-rings and is arranged to slide in a tubular bushing (31) lining the cavity, the O-rings being arranged to be in contact with the bushing.

12. An instrument according to claim 10 wherein the dome comprises a substantially hemispherical wall.

13. An instrument according to claim 12, wherein the wall is made of a plastics material, in particular of polycarbonate.

14. An instrument according to claim 10, wherein the travel mechanism comprises:

a first actuator for causing the detector to move in translation along the longitudinal axis of the instrument;

a second actuator for causing the detector to move in turning about the longitudinal axis; and a third actuator for causing the detector to move in pivoting about an axis that is substantially orthogonal to the longitudinal axis.

15. A cell including a wall pierced by a cavity and an instrument according to claim 10 that extends inside the cavity.

16. A cell according to claim 15, wherein the wall of the cell includes an abutment that is movable between a stop position in which the abutment prevents the dome from being expelled into the cell, and a release position in which the abutment allows the dome to be expelled into the cell.

* * * * *